US007530610B2

(12) United States Patent
Tanimoto et al.

(10) Patent No.: US 7,530,610 B2
(45) Date of Patent: May 12, 2009

(54) DOOR HANDLE FOR VEHICLE

(75) Inventors: Tetsurou Tanimoto, Anjo (JP); Masaki Nishikawa, Kariya (JP); Yoshimasa Suzuki, Chita (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 11/199,265

(22) Filed: Aug. 9, 2005

(65) Prior Publication Data

US 2006/0037371 A1 Feb. 23, 2006

(30) Foreign Application Priority Data

Aug. 23, 2004 (JP) ..... 2004-242451

(51) Int. Cl.
*E05B 3/00* (2006.01)
*E05B 1/00* (2006.01)

(52) U.S. Cl. ..... 292/336.3; 292/347; 292/348

(58) Field of Classification Search ..... 292/336.3, 292/350, 354, 347, DIG. 22, DIG. 65, DIG. 27, 292/92; 49/460; 16/112.1, 412, 436, 438, 16/DIG. 24; 70/208
See application file for complete search history.

(56) References Cited

U.S. PATENT DOCUMENTS

| | | | | |
|---|---|---|---|---|
| 3,795,416 A | | 3/1974 | Hehl et al. | |
| 5,706,554 A | * | 1/1998 | Ruckert et al. | 292/336.3 |
| 5,934,025 A | | 8/1999 | Trap et al. | |
| 6,048,006 A | * | 4/2000 | Antonucci et al. | 292/336.3 |
| 6,363,577 B1 | * | 4/2002 | Spitzley | 292/336.3 |
| 6,401,302 B1 | * | 6/2002 | Josserand et al. | 16/444 |
| 6,550,295 B2 | * | 4/2003 | Hubner | 70/208 |
| 6,565,134 B1 | * | 5/2003 | Stuart et al. | 292/336.3 |
| 6,594,861 B2 | * | 7/2003 | Dimig et al. | 16/412 |
| 2003/0001399 A1 | * | 1/2003 | Sato | 292/336.3 |
| 2003/0011202 A1 | * | 1/2003 | Kwak | 292/336.3 |
| 2003/0122385 A1 | * | 7/2003 | Monig | 292/336.3 |

FOREIGN PATENT DOCUMENTS

| | | |
|---|---|---|
| DE | 195 27 888 A1 | 2/1997 |
| EP | 0 635 609 A1 | 1/1995 |
| JP | 3326380 | 7/2002 |

OTHER PUBLICATIONS

European Search Report dated Dec. 9, 2005.

* cited by examiner

*Primary Examiner*—Patricia L Engle
*Assistant Examiner*—Alyson M Merlino
(74) *Attorney, Agent, or Firm*—Buchanan Ingersoll & Rooney PC

(57) ABSTRACT

A door handle for a vehicle including a handle for opening and closing a vehicle door, and a base fixed to an outer panel of the vehicle door and rotatably supporting the handle includes an opening formed on the outer panel and including a portion having a first width, and a base frame formed on one end side of the base and including a portion having a second width larger than the first width. The portion having the second width of the base frame intrudes into a vehicle interior side of the outer panel through the opening when the base frame is fixed to the outer panel from a vehicle exterior side. The door handle for a vehicle further includes a tightening portion formed on the other end side of the base and tightening the base relative to the outer panel.

19 Claims, 3 Drawing Sheets

DOOR HANDLE FOR VEHICLE

CROSS REFERENCE TO RELATED APPLICATIONS

This application is based on and claims priority under 35 U.S.C. § 119 to Japanese Patent Application No. 2004-242451, filed on Aug. 23, 2004, the entire content of which is incorporated herein by reference.

FIELD OF THE INVENTION

This invention generally relates to a door handle for a vehicle. More particularly, this invention pertains to a door handle for a vehicle operated by an occupant for opening and closing a vehicle door.

BACKGROUND

Various structures have been proposed for a door handle for a vehicle for opening and closing a vehicle door. For example, a known door handle for a vehicle is disclosed in JP3326380B2. The door handle for a vehicle disclosed is in a substantially identical plane with an outer panel of a vehicle door. The door handle is rotatable relative to two rotational centers for the purposes of reducing a positional change of the handle in a rotational direction.

When the door handle is assembled to the outer panel that forms an exterior surface of the vehicle door, the door handle is constituted so as to form a substantially identical plane with the outer panel without protruding therefrom. That is, a case rotatably supporting the handle includes an exterior surface formed in a substantially identical plane with the outer panel when assembled to the vehicle. Further, the exterior surface of the case includes a hole into which a keyhole of a key cylinder, which is integrally formed with the door handle when the door handle is assembled to the vehicle door, is disposed.

When the aforementioned door handle is fixed to the vehicle door, a bolt tightening may be implemented on multiple portions on a vehicle interior side of the outer panel. That is, the case may be fixed unstably in the rotational direction of the door handle by means of one portion of bolt tightening and thus at least two portions of bolt tightening are employed for secure tightening so as to prevent the case from rotating.

A recent vehicle door may accommodate therein a beam for ensuring rigidity against collision, a power window mechanism, a power door lock mechanism, and the like. Therefore, when the door handle is assembled to the vehicle door, only a small space is available, thereby causing a difficulty in assembly.

Thus, a need exists for a door handle for a vehicle that can be easily assembled to a vehicle door. Precisely, a need exists for a door handle for a vehicle that can be surely fixed to a vehicle door by means of one bolt.

SUMMARY OF THE INVENTION

According to an aspect of the present invention, a door handle for a vehicle includes a handle for opening and closing a vehicle door, and a base fixed to an outer panel of the vehicle door and rotatably supporting the handle. The outer panel has an opening that has a portion having a first width. The base has a base frame formed on one end side of the base. The base frame includes a portion having a second width larger than the first width. The portion having the second width of the base frame intrudes into a vehicle interior side of the outer panel through the opening when the base frame is fixed to the outer panel from a vehicle exterior side. The door handle for a vehicle further includes a tightening portion formed on the other end side of the base and tightening the base relative to the outer panel.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention is explained with reference to the attached drawings. The present embodiment is employed, as an example, in a flap-type door handle horizontally attached to an outer panel of a vehicle. According to such a flap-type door handle, a vehicle door is opened by inserting fingers between the outer panel and the door handle, and then pulling the door handle outward and upward.

Figure 1:
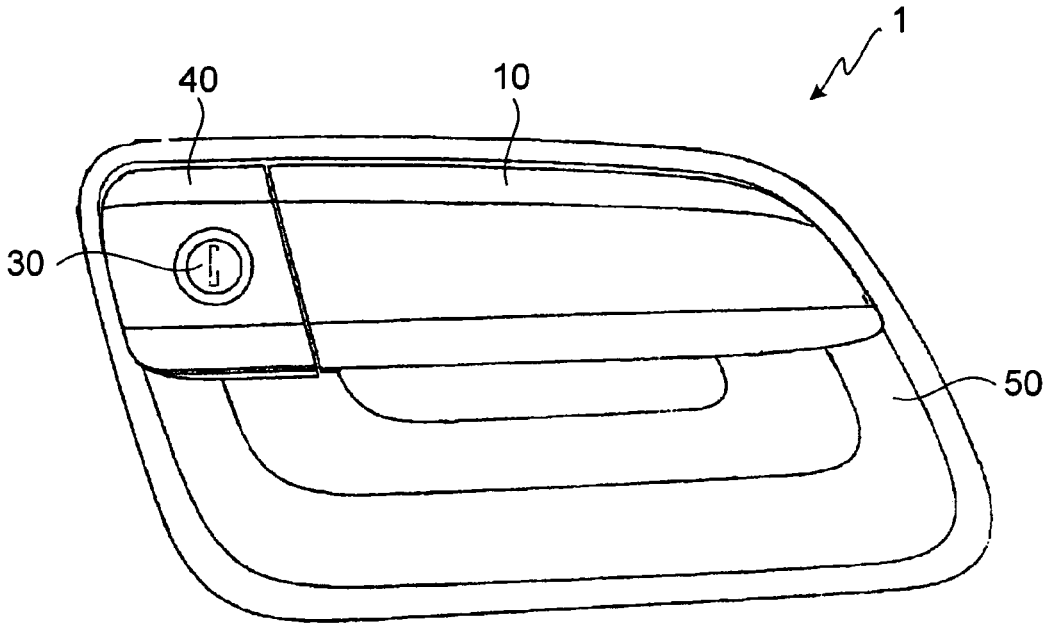
FIG. 1 is a front view of a door handle according to an embodiment of the present invention.
Figure 4:
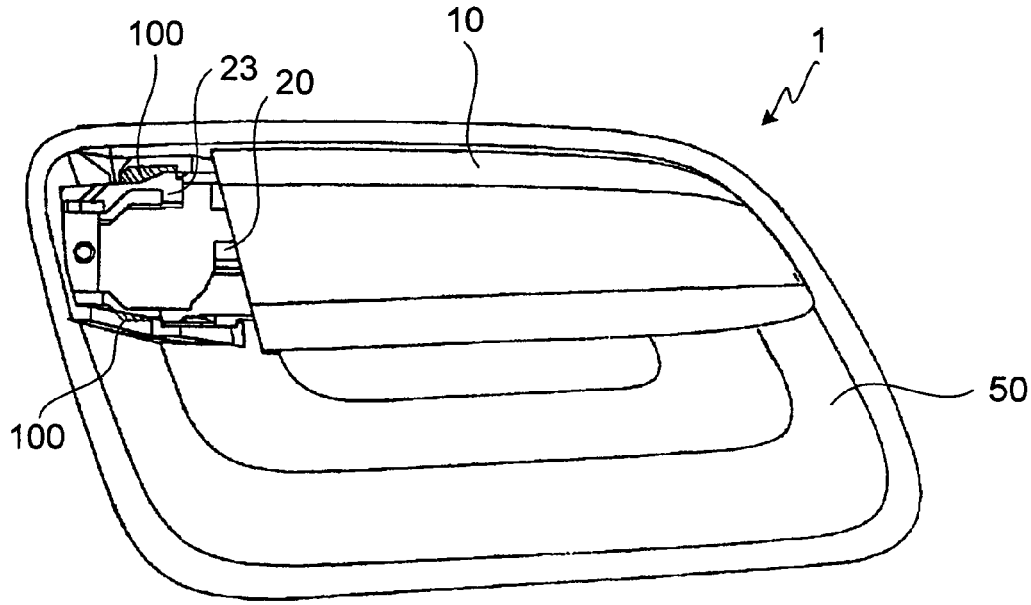
FIG. 4 is a front view of the door handle with a key cylinder removed according to the embodiment of the present invention.

FIG. 1 is a front view of a vehicle door handle 1 according to the present embodiment assembled to an outer panel 50. The vehicle door handle 1 includes a handle 10, a base 20, a key cylinder 30, and a key cylinder cover 40. The base 20 is arranged on a vehicle interior side of the handle 10 so as to face the handle 10, as shown in FIG. 4. The handle 10 is assembled to the base 20 such that the handle 10 is rotatable in an upward direction from a vehicle exterior side. Further, as shown in FIG. 1, the key cylinder 30 is covered by the key cylinder cover 40. When the handle 10 is pulled upward from the vehicle exterior side, a known vehicle lock mechanism (not shown) connected to a link portion (not shown) of the handle 10 is brought in an unlocked state, thereby opening the vehicle door. In FIG. 1, a portion of the outer panel 50 to which the door handle 1 is assembled is only shown.

Figure 2:
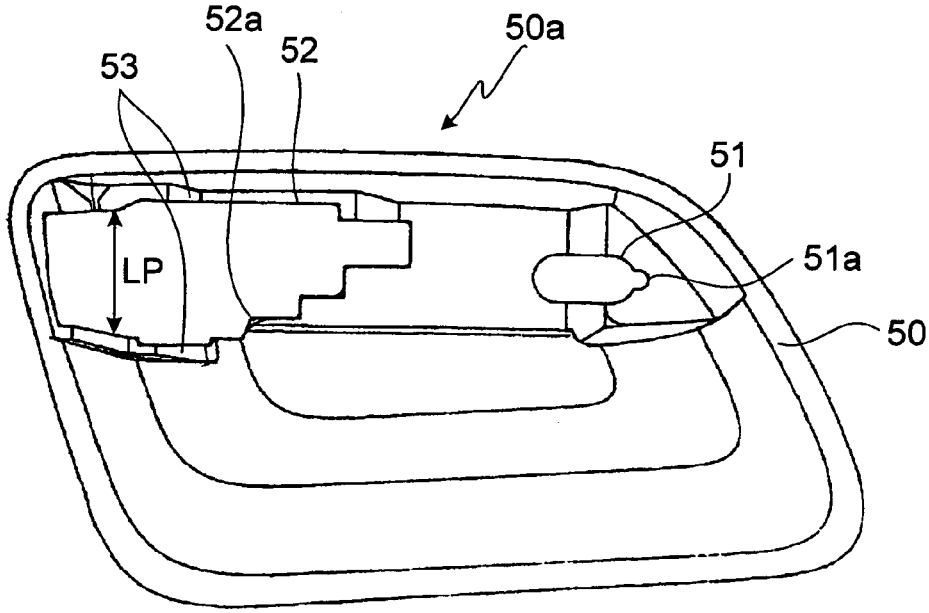
FIG. 2 is an outer panel according to the embodiment of the present invention.

FIG. 2 is a front view of the outer panel 50. The outer panel 50 includes a press-molded door handle attaching portion 50*a* whose center portion is recessed towards the vehicle interior side. The attaching portion 50*a* includes an opening 52 on one end side and a bolt-hole 51 on the other end side. The bolt-hole 51 is provided for tightening the base 20 relative to the outer panel 50 by means of a bolt. The opening 52 is provided for placing a base frame 23 (to be explained later) of the base 20 into the vehicle interior side of the outer panel 50. The opening 52 has an elongated shape in a vehicle longitudinal direction. In addition, the opening 52 includes a step-like portion 52*a* whose width is gradually decreased in a stepped manner towards the bolt-hole 51. Further, the opening 52 includes a portion having a first width LP (i.e. a first width LP portion) provided on an opposite side to the bolt-hole 51. A stepped portion 53 is then formed on a right side of the first width LP portion in FIG. 2. Precisely, the stepped portion 53 for forming a step between the first width portion LP and the step-like portion 52*a* on a vertically outer side of the vehicle door. According to this stepped portion 53, the first width LP portion protrudes in the vehicle exterior direction from the step-like portion 52*a*.

Figure 3:
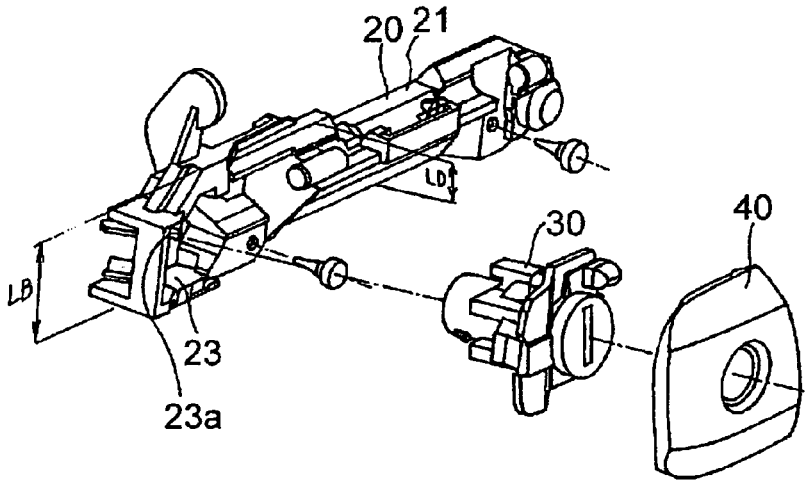
FIG. 3 is a perspective view of the door handle according to the embodiment of the present invention.

FIG. 3 is a perspective view of the base 20, the key cylinder 30, and the key cylinder cover 40 of the door handle 1. The base 20 is integrally formed by resin, and includes an attaching portion 21 attached to the vehicle exterior side of the outer panel 50 and the base frame 23. The base frame 23 is formed on one end side of the base 20 and includes a hole at a center into which the key cylinder 30 is inserted. A key cylinder portion is completed by inserting the key cylinder 30 into the hole of the base frame 23, and then attaching the key cylinder cover 40 to the key cylinder 30 from an outside, i.e. vehicle exterior side.

As shown in FIG. 3, the base frame 23 includes a portion having a second width LB (i.e. a second width LB portion) in a vehicle vertical direction. The second width LB is specified larger than the first width LP. In addition, a portion having a width LD, (i.e. a positioning width LD portion), is formed between the base frame 23 and the attaching portion 21 of the base 20. The positioning width LD portion is disposed into a corresponding portion of the step-like portion 52*a* when the base 20 is assembled to the outer panel 50. The positioning width LD is specified smaller than a width of that corresponding portion of the step-like portion 52*a* by a fit tolerance between the positioning width LD portion and the corresponding part of the step-like portion 52*a*. Then, the position of the base 20 in the vehicle vertical direction relative to the outer panel 50 is determined, i.e. the base 20 is located at a predetermined position in terms of the vehicle vertical direction of the outer panel 50, by a fitting between the positioning width LD portion and the corresponding portion of the step-like portion 52*a*. The positioning width LD portion may be alternately formed on a portion of the base frame 23 or the attaching portion 21. Further, the base frame 23 includes a stopper 23*a* protruding at an end portion. The position of the base 20 in a vehicle longitudinal direction relative to the outer panel 50 is determined by the stopper 23*a* made contact with an end portion in the vehicle longitudinal direction of the opening 52 of the outer panel 50.

FIG. 4 is a front view of the vehicle door handle 1 assembled to the outer panel 50 in a state in which the key cylinder 30 is not attached. The base 20, precisely, the base frame 23 is exposed from a portion where the key cylinder 30 and the key cylinder cover 40 are attached in FIG. 1.

According to the vehicle door handle 1 having the aforementioned structure, when the base 20 is assembled to the outer panel 50, the base 20 is first tilted either in an upward or downward direction relative to a longitudinal axis of the base 20. Further, the base 20 is tilted relative to the outer panel 50 so that a portion of the base 20 where the base frame 23 is formed approaches the opening 52. Then, the base frame 23 is inserted into the opening 52 so that the base frame 23 enters deeply, i.e. intrudes into, the vehicle interior side of the outer panel 50.

Afterwards, the base 20 is brought to be in parallel to the outer panel 50 so that the base 20 is positioned relative to the outer panel 50.

In this case, the base frame 23 includes the second width LB portion whose width is larger than that of the first width LP portion of the opening 52. Thus, as shown by shaded areas in FIG. 4, an entering portion 100 intruding into the vehicle interior side of the outer panel 50 is formed by the base frame 23. The entering portion 100 is in contact with the outer panel 50 from the vehicle interior side thereof, i.e. in contact with the vehicle interior side of the outer panel 50. In such circumstances, the base frame 23 is fixed to the outer panel 50.

Figure 5:
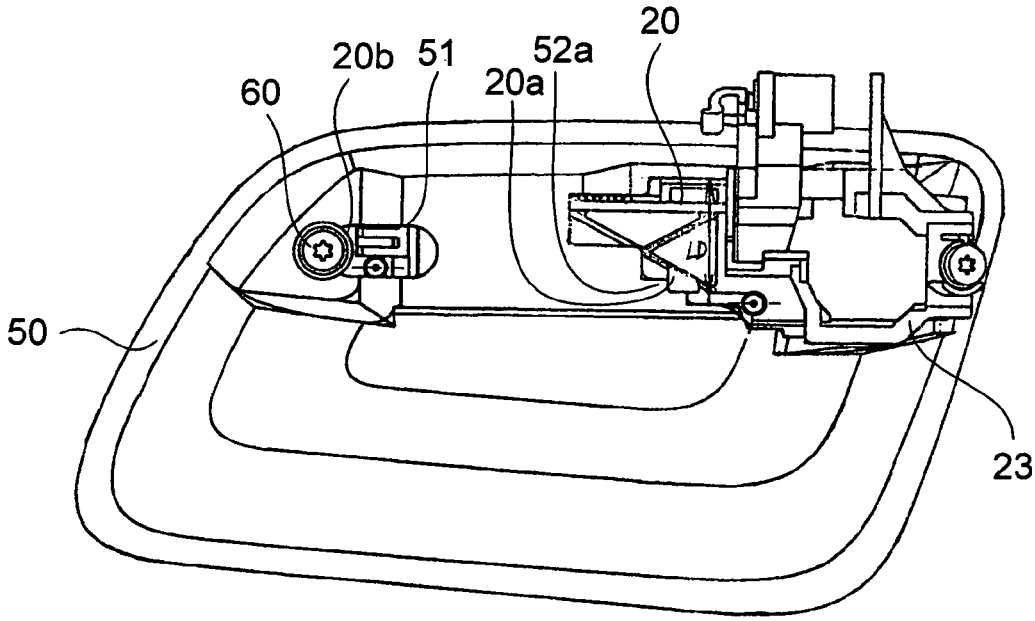
FIG. 5 is a view of the door handle when viewed from a vehicle interior side of the outer panel.

FIG. 5 is a view of the door handle 1 in a state of FIG. 4 when viewed from the vehicle interior side of the outer panel 50. The base 20 is tightened relative to the outer panel 50 from the vehicle exterior side by means of a bolt 60 at a bolt tightening portion 20*b* formed on the other end side of the base 20 and a tightening portion 51*a* (see FIG. 2) of the bolt-hole 51 of the outer panel 50. Further, the base frame 23 is exposed to the vehicle interior side from the opening 52 and fixed to the outer panel 50 from the vehicle interior side thereof. The positioning width LD portion formed on the base 20 is caught in a portion of the step-like portion 52*a* so that the base 20 is positioned relative to the outer panel 50. The base 20 further includes a hook-shaped engaging portion 20*a* in a corresponding position to the step-like portion 52*a* of the opening 52. The engaging portion 20*a* sandwiches the outer panel 50 from both the vehicle interior side and the vehicle exterior side.

Therefore, according to the present embodiment, the outer panel 50 is sandwiched by the entering portion 100 and the attaching portion 21 formed on the base frame 20, in addition to the engaging portion 20*a*, thereby achieving a stronger fixing between the base 20 and the outer panel 50.

According to the present embodiment, the entering portion 100 is formed on the base frame 23 into which the key cylinder 30 is inserted. However, even if the base frame 23 is not provided to the base 20, it is acceptable as long as the entering portion 100 is formed on a fitting portion of the base 20.

According to the aforementioned embodiment, the base frame 23 having the larger width than that of the opening 52 formed on the outer panel 50 of the vehicle is inserted into the opening 52 and then the base 20 is bolt-tightened to the outer panel 50 for fixation. In such circumstances, the base frame 23 intrudes into the vehicle interior side of the outer panel 50 while a main body of the base 20 is fixed to the outer panel 50 from the vehicle exterior side. Since the base 20 sandwiches the outer panel 50 in a parallel manner from the vehicle interior side and the vehicle exterior side, the base 20 is strongly fixed to the outer panel 50.

That is, the door handle 1 may be fixed by means of one portion of bolt tightening.

In addition, according to the aforementioned embodiment, the key cylinder 30 is inserted into the base frame 23 so as to be fixed to the outer panel 50 together with the base frame 23. Thus, the base 20 may be more strongly fixed to the outer panel 50.

Further, according to the aforementioned embodiment, the base frame 23 includes the portion having the positioning width LD that is specified smaller than a width of the portion of the opening 20 by a fit tolerance. Thus, a position of the door handle 1 in the vehicle vertical direction is determined and at the same time fixation of the door handle 1 may be stronger due to the bolt tightening.

Furthermore, according to the aforementioned embodiment, the stepped portion 53 is formed on a portion of the outer panel 50 where the opening 52 is formed. Thus, even if the attaching portion 21 and the base frame 23 of the base are linearly formed, the base 20 may be sandwiched from the vehicle interior side and the exterior side of the outer panel 50, thereby achieving a strong fixation of the base 20. Further, since the stepped portion 53 is formed by bending, flexural rigidity of the door handle attaching portion 50*a* of the outer panel 50 may be improved. As a result, the fixation of the door handle 1 may be further improved.

Furthermore, according to the aforementioned embodiment, the engaging portion 20*a* formed on the base 20 sandwiches the outer panel 50. Thus, the base frame 23 intrudes into the vehicle interior side of the outer panel 50 and sandwiches the outer panel 50, thereby enabling a strong fixation of the door handle 1.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A door handle assembly for a vehicle comprising:

a handle for opening a vehicle door;

a base fixed to an outer panel which has an opening including a portion having a first width, the handle being supported by the base so as to be pivotable relative to a longitudinal axis of the base, the base rotatably supporting the handle, the base including a base frame formed on one end of the base, the base frame including a portion having a second width larger than the first width, the portion of the base frame having the second width positioned on a vehicle interior side of the outer panel at the portion of the opening having the first width so that the portion of the outer panel having the first width prevents the portion of the base frame having the second width from moving toward the vehicle exterior side of the outer panel when the handle is rotated to open the vehicle door; and a tightening portion formed on the other end of the base tightened to the outer panel from the vehicle exterior side of the outer panel by a bolt.

2. A door handle assembly for a vehicle according to claim 1, wherein the base is fixed to the outer panel via the base frame and the tightening portion.

3. A door handle assembly for a vehicle according to claim 2, wherein the base frame is in contact with the vehicle interior side of the outer panel.

4. A door handle assembly for a vehicle according to claim 3, wherein the base frame includes a key cylinder inserted into a hole portion.

5. A door handle assembly for a vehicle according to claim 1, wherein the base frame includes a portion having a positioning width, the portion having the positioning width being positioned in a step-shaped portion of the opening of the outer panel.

6. A door handle assembly for a vehicle according to claim 1, wherein the opening includes a step-shaped portion whose width gradually decreases in a stepped manner from one end of the outer panel toward the other end of the outer panel.

7. A door handle assembly for a vehicle according to claim 6, wherein the outer panel includes a stepped portion forming a step between the portion having the first width and the step-shaped portion so that the portion having the first width protrudes in a direction towards the vehicle exterior side from the vehicle interior side.

8. A door handle assembly for a vehicle according to claim 6, wherein the base includes an engaging portion in a corresponding position to the step-shaped portion of the outer panel, and the engaging portion sandwiches the outer panel.

9. A door handle assembly for a vehicle comprising:

a handle for opening a vehicle door;

a base fixed to an outer panel which has an opening including a portion having a first width, the handle being supported by the base so as to be pivotable relative to a longitudinal axis of the base, the base rotatably supporting the handle, the base including a base frame formed on one end of the base, the base frame including a portion having a second width larger than the first width, the portion of the base frame having the second width positioned on a vehicle interior side of the outer panel at the portion of the opening having the first width so that the portion of the outer panel having the first width prevents the portion of the base frame having the second width from moving toward the vehicle exterior side of the outer panel when the handle is rotated to open the vehicle door; and the base including a tightening portion tightened to the outer panel.

10. A door handle assembly for a vehicle according to claim 9, wherein the base is fixed to the outer panel by engagement of the portion of the base frame having the second width with the portion of the outer panel having the first width, and by a bolt engaging the tightening portion.

11. A door handle assembly for a vehicle according to claim 9, wherein the portion of the base frame having the second width contacts the vehicle interior side of the outer panel.

12. A door handle assembly for a vehicle according to claim 9, wherein the base frame includes a key cylinder positioned in a hole portion.

13. A door handle assembly for a vehicle according to claim 9, wherein the base frame includes a portion having a positioning width, and the opening in the outer panel includes a step-shaped portion, the portion of the base frame having the positioning width being positioned in the step-shaped portion of the opening of the outer panel.

14. A door handle assembly for a vehicle according to claim 1, wherein the tightening portion of the base is positioned on the vehicle exterior side of the outer panel.

15. A door handle assembly for a vehicle comprising:

a base fixed to an outer panel which has an opening including a portion having a first width;

the base including a base frame on a first end of the base, the base frame including a portion having a second width larger than the first width;

a handle rotatably supported by the base to as to be pivotable relative to a longitudinal axis of the base and operable to open a vehicle door;

the portion of the base frame having the second with positioned on a vehicle interior side of the outer panel at the portion of the opening having the first width so that the portion of the outer panel having the first width prevents the portion of the base frame having the second width from moving toward the vehicle exterior side of the outer panel when the handle is rotated to open the vehicle door; and the base including a tightening portion tightened to the outer panel.

16. A door handle assembly for a vehicle according to claim 15, wherein the tightening portion is at a second end of the base opposite the first end, the tightening portion being positioned on the vehicle exterior side of the outer panel.

17. A door handle assembly for a vehicle according to claim 16, wherein the base is fixed to the outer panel by engagement of the portion of the base frame having the second width with the portion of the outer panel having the first width, and by a bolt engaging the tightening portion.

18. A door handle assembly for a vehicle according to claim 16, wherein the portion of the base frame having the second width contacts the vehicle interior side of the outer panel.

19. A door handle assembly for a vehicle according to claim 1, wherein a head of the bolt is positioned at the vehicle interior side of the outer panel.

* * * * *